US006346033B1

(12) United States Patent
Lamprecht et al.

(10) Patent No.: US 6,346,033 B1
(45) Date of Patent: Feb. 12, 2002

(54) METHOD FOR POLISHING DISK SHAPED WORKPIECES AND DEVICE FOR CARRYING OUT THE METHOD

(75) Inventors: Ludwig Lamprecht, Altenmarkt; Rupert Köckeis, Schönberg; Rainer Neumann, Kirchdorf, all of (DE)

(73) Assignee: Wacker Siltronic Gesellschaft für Halbleitermaterialien AG, Burghausen (DE)

( * ) Notice: Subject to any disclaimer, the term of this patent is extended or adjusted under 35 U.S.C. 154(b) by 0 days.

(21) Appl. No.: 09/205,972

(22) Filed: Dec. 4, 1998

(30) Foreign Application Priority Data

Dec. 18, 1997 (DE) ..... 197 56 536

(51) Int. Cl.[7] ..... B24B 7/22
(52) U.S. Cl. ..... 451/57; 451/288
(58) Field of Search ..... 451/5, 288, 287, 451/290, 41, 57, 65, 24

(56) References Cited

U.S. PATENT DOCUMENTS 3,863,394 A * 2/1975 Dumentat ..... 451/259
5,329,732 A * 7/1994 Karlsrud et al. ..... 451/290
5,361,545 A * 11/1994 Nakamura ..... 451/290
5,980,361 A * 11/1999 Muller et al. ..... 451/288

FOREIGN PATENT DOCUMENTS

DE 1914082 * 10/1969 ..... 451/290
DE 29709755 10/1997

OTHER PUBLICATIONS

Derwent Abstract Corresponding to DE 297 09 755 01.
German Patent Application No. 196 51 7613 (ST9608).
Translation of the German Patent Application No. 196 51 7613 (ST9608).

* cited by examiner

*Primary Examiner*—Robert A. Rose
(74) *Attorney, Agent, or Firm*—Collard & Roe, P.C

(57) ABSTRACT

A method and a device for polishing disk shaped workpieces, has semiconductor wafers fixed on carrier plates, the carrier plates being pressed against a polishing plate, over which a polishing cloth is stretched, by means of polishing heads, and the polishing heads are accommodated in a polishing-plate superstructure. The carrier plates, following a polishing operation, are simultaneously lifted off the polishing plate by means of lifting devices in the polishing heads. The polishing-plate superstructure is displaced, together with the carrier plates, along a linear guide above a polishing line.

12 Claims, 2 Drawing Sheets

METHOD FOR POLISHING DISK SHAPED WORKPIECES AND DEVICE FOR CARRYING OUT THE METHOD

BACKGROUND OF THE INVENTION

1. Field of the Invention

The present invention relates to a method for polishing disk shaped workpieces, in particular for the single side polishing of semiconductor wafers. The invention also relates to a device which is suitable for carrying out the method.

2. The Prior Art

During the single side polishing of semiconductor wafers, the rear sides of the semiconductor wafers are fixed onto carrier plates. The front sides of the semiconductor wafers are polished, by having a plurality of carrier plates pressed against a polishing plate, over which a polishing cloth is stretched. The polishing then occurs by means of polishing heads of a polishing machine. The polishing plate and the carrier plates rotate during the polishing. Usually, before a polishing operation takes place, a manipulator transfers the carrier plates, which are covered with the fixed semiconductor wafers, to the polishing heads. This manipulator receives them again following the polishing operation. The carrier plates are transferred sequentially. The polishing heads are brought together in a polishing-plate superstructure. The polishing plate and the polishing-plate superstructure are supported on a common machine frame.

The prior art method and the use of the polishing machines described only permits the obtaining of semiconductor wafers with smooth and planar front sides achieved to a limited extent.

SUMMARY OF THE INVENTION

It is an object of the present invention to provide a modified polishing method and a device for carrying out this method which method avoids the drawbacks associated with known polishing methods and polishing machines.

The present invention relates to a method for polishing disk shaped objects, in particular semiconductor wafers, which are fixed on carrier plates. The carrier plates are pressed against a polishing plate, over which a polishing cloth is stretched, by means of polishing heads. The polishing heads are accommodated in a polishing-plate superstructure, wherein the carrier plates, following a polishing operation, are simultaneously lifted off the polishing plate by means of lifting devices in the polishing heads. The polishing-plate superstructure is displaced, together with the carrier plates, along a linear guide above a polishing line.

The method is distinguished by the fact that the workpieces are treated absolutely uniformly due to the simultaneous manipulation of the carrier plates. As a result, the planarity values, for example, of the polished sides of the wafers are much more uniform from one wafer to the next wafer.

The invention also relates to a device for carrying out the method, wherein lifting devices, by means of which the carrier plates can be simultaneously lifted off the polishing plate, are provided in the polishing heads, and the polishing-plate superstructure can be displaced, together with the carrier plates, along a linear guide above a polishing line.

BRIEF DESCRIPTION OF THE DRAWINGS

Other objects and features of the present invention will become apparent from the following detailed description considered in connection with the accompanying drawings which disclose a few embodiments of the present invention. It should be understood, however, that the drawings are designed for the purpose of illustration only and not as a definition of the limits of the invention.

The invention is described in more detail below with reference to figures, in which.

DETAILED DESCRIPTION OF PREFERRED EMBODIMENTS

Figure 1:
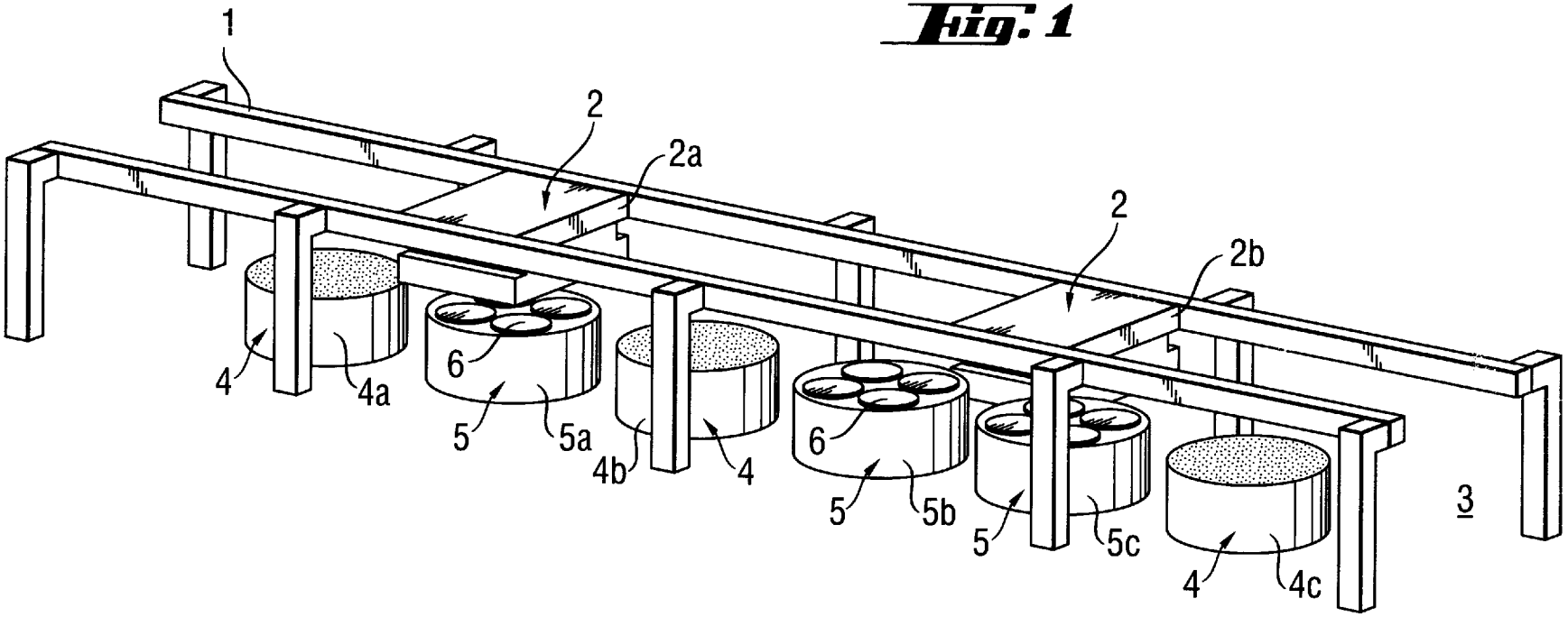
FIG. 1 shows a perspective view of a preferred embodiment of the device of the invention.

Turning now in detail to the drawings, FIG. 1 shows a device comprising a frame, which is designed as a linear guide 1. A polishing-plate superstructure 2 is referred to below as a portal and can be displaced along the linear guide. The portal is supported by the linear guide and is situated above a polishing line 3 which is formed by at least one receiving station 4 for carrier plates and at least one polishing plate 5. It is particularly preferred for the polishing plate and the portal to be decoupled from one another both thermally and in terms of vibration mechanisms. There should be no mechanical connection between the polishing plate and the portal. In the case of the device illustrated, this is achieved by the fact that the linear guide 1 supports only the portal 2 and not the polishing plate 5. The advantage of this construction is that heat and vibrations generated by the portal, which have an adverse effect on the result of polishing of the semiconductor wafers, can scarcely be transmitted to the polishing plate.

The linear guide may also bear a plurality of portals. Equally, the polishing line may have a plurality of polishing plates and a plurality of receiving stations for carrier plates, in which case these components may be designed for different functions. For example, the polishing plates can be distinguished according to the type of polishing carried out there and the polishing cloths and polishing abrasives used. The receiving stations may be constructed to provide a repository for the carrier plates. They may also have a function which goes beyond this. For example, they may be a treatment station in which the semiconductor wafers are brought into contact with a liquid. In this case, it is useful to construct them as tanks which can be filled with the liquid. The liquid may be water or a cleaning liquid or a liquid which contains chemically active substances. For example, these chemically active substances may be useful for breaking the connection between the semiconductor wafers and the carrier plates or for etching. Also, these substances may be useful for chemically modifying the surfaces of the semiconductor wafers, for example for rendering the surfaces hydrophilic.

In a preferred embodiment, it is possible to lengthen the linear guide and the polishing line without difficulty. Also, if appropriate, it is possible to be able to add further portals, polishing plates and receiving stations. Such modular extendibility, and the ease of access to the polishing line, with the associated possibility of quickly replacing existing polishing plates and receiving stations with further developments, provide the device with particular flexibility and safeguards for the future.

The receiving station 4*a* of the embodiment illustrated in FIG. 1 serves as a loading station from which the prepared carrier plates 6 are lifted. If appropriate, the portal 2*a* must first be displaced into a position above the receiving station

4*a*. Lifting devices in the polishing heads of the portal then allow the prepared carrier plates to be lifted simultaneously out of the receiving station and allow the semiconductor wafers which are fixed thereon to be fed to a polishing operation. For the polishing operation, a first polishing plate 5*a* is provided in the polishing line, on which polishing plate a rough polishing is carried out. The portal 2*a* is therefore displaced, together with the carrier plates, along the linear guide until it has reached a position above the polishing plate 5*a*. The semiconductor wafers are then polished in the usual way, in that the carrier plates are pressed against the surface of the polishing plate, over which a polishing cloth is stretched, by the polishing heads.

After the polishing operation, the carrier plates are simultaneously lifted off the polishing plate by means of the lifting devices in the polishing heads. This is particularly advantageous since as a result the semiconductor wafers are treated uniformly. Also, the polishing abrasive is prevented from being able to act on the semiconductor wafers for different lengths of time. If this abrasive were to do so, the quality of the polishing result could be considerably impaired.

The polishing line in accordance with FIG. 1 comprises a further receiving station 4*b* for carrier plates, which is constructed to function as a treatment station. The carrier plates deposited therein can be brought into contact with a liquid, for example with a cleaning agent or with an etching agent. This agent cleans polishing agent residues or abraded material from the semiconductor wafers or exerts a chemical action on the semiconductor wafers. The portal 2*a* is displaced, together with the carrier plates, from its position above the polishing plate 5*a*, along the linear guide, into a position above the receiving station 4*b*. The carrier plates are then again simultaneously deposited in the receiving station.

The polishing line 3 furthermore comprises two additional polishing plates 5*b* and 5*c* and a further receiving station 4*c* for carrier plates. The polishing plates 5*b* and 5*c* are provided with intermediate polishing and final polishing of the semiconductor wafers. The carrier plates are conveyed with the aid of a further portal 2*b*. By means of lifting devices of the polishing heads accommodated in the portal 2*b*, the carrier plates are initially simultaneously lifted out of the receiving station 4*b*. Then, the portal 2*b*, together with the carrier plates, is displaced to a position above the polishing plate 5*b*. After the following intermediate polishing of the semiconductor wafers, the carrier plates 6 are again lifted off the polishing plate 5*b* and are conveyed into a position above the polishing plate 5*c*.

After the following fine polishing, the carrier plates 6 are simultaneously lifted off the polishing plate 5*c*, and the portal 2*b*, together with the carrier plates, is displaced into a position above the receiving station 4*c*. Then, the carrier plates are deposited in the receiving station. The receiving station 4*c* is constructed as an unloading station in which the semiconductor wafers can, for example be cleaned with a liquid and stored until the carrier plates are conveyed further. Naturally, it is also possible to operate the device in such a way that a plurality of available polishing-plate superstructures are displaced simultaneously above the polishing line.

It is possible to displace the polishing-plate superstructures along the linear guide, with the polishing-plate superstructures being enabled by means to be displaceable independently along the linear guide either successively or simultaneously.

Figure 2:
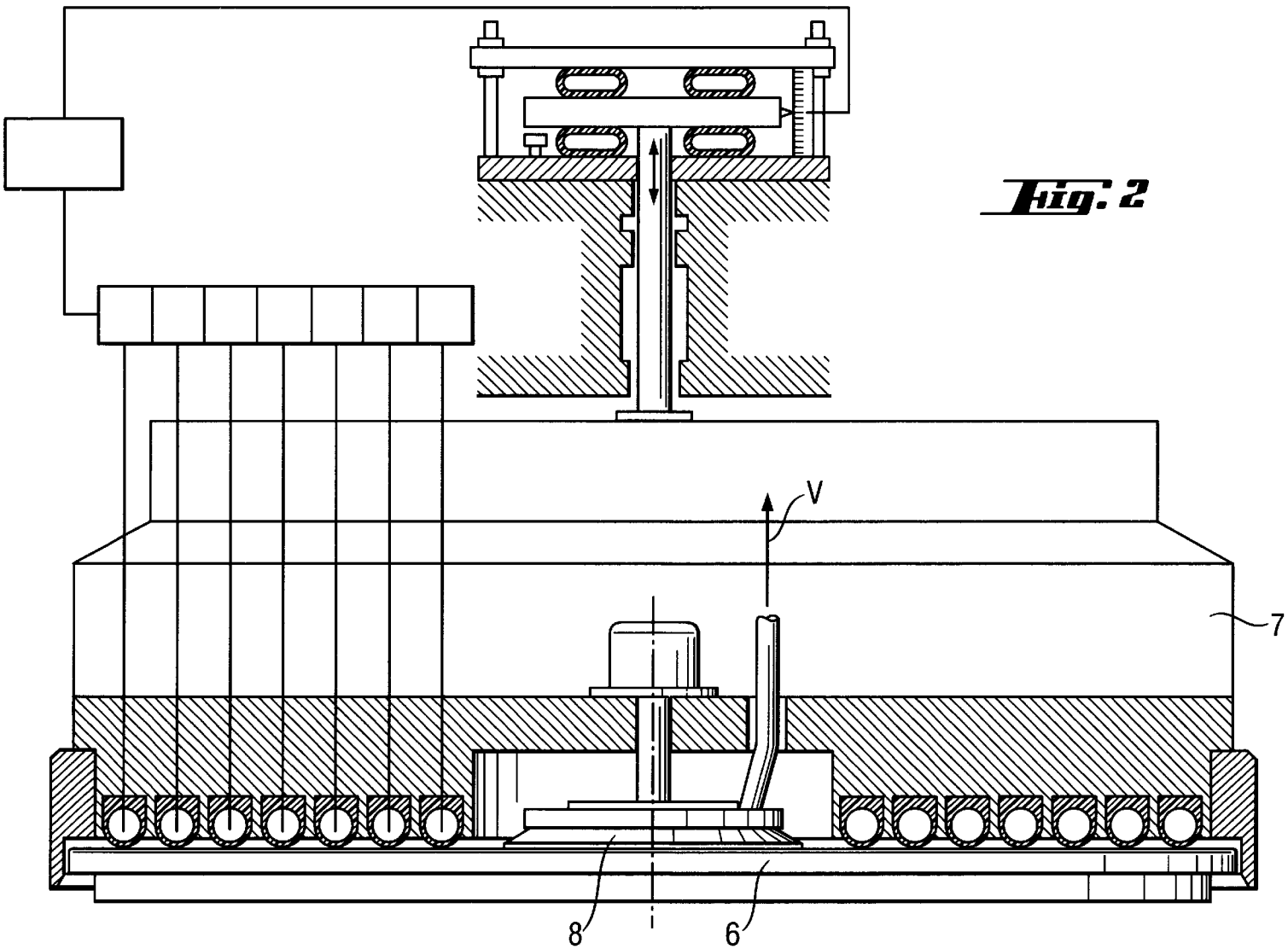
FIG. 2 shows a sectional view of a preferred embodiment of a polishing head.

FIG. 2 illustrates a preferred embodiment of a polishing head. The functions of the most important features of the polishing head are described in detail in the German Patent Application serial number P 19651761.3. This corresponds to U.S. patent application Ser. No. 08/987,515 filed Dec. 9, 1997. In connection with the present invention, it should be emphasized that the polishing head 7, together with further polishing heads, is accommodated in the portal 2 and has a lifting device 8. The lifting device is a vacuum tool which, by applying a vacuum V, sucks a carrier plate 6 onto it. According to the invention, after a polishing operation, a plurality of carrier plates are lifted up simultaneously, and the portal, together with the carrier plates, is displaced along the linear guide.

Accordingly, while a few embodiments of the present invention have been shown and described, it is to be understood that many changes and modifications may be made thereunto without departing from the spirit and scope of the invention as defined in the appended claims.

What is claimed is:

1. A method for polishing disk shaped workpieces comprising providing a polishing line comprising at least three stations comprising at least a polishing plate and at least a receiving station for carrier plates;

providing at least two polishing-plate superstructures in which polishing heads are accomodated;

providing a linear guide situated above the polishing line and bearing the at least two polishing-plate superstructures;

fixing disk shaped workpieces on the carrier plates;

polishing the workpieces by pressing the carrier plates by means of the polishing heads against the polishing plate;

simultaneously lifting the carrier plates off the polishing-plate by lifting means in the polishing heads; and displacing the polishing-plate superstructures along the linear guide, the polishing-plate superstructures being enabled to be displaceable independently along the linear guide either successively or simultaneously.

2. The method as claimed in claim 1, comprising treating the workpieces with a liquid in the receiving station.

3. The method as claimed in claim 1, wherein each workpiece is a semiconductor wafer.

4. The method as claimed in claim 1, comprising simultaneously lifting the carrier plates off a first receiving station;

displacing the polishing-plate superstructure, together with the carrier plates, along the linear guide from a position above the first receiving station to a position above a polishing plate;

polishing the workpieces on the polishing plate;

simultaneously lifting the carrier plates off the polishing plate;

displacing the polishing-plate superstructure, together with the carrier plates, along the linear guide from a position above the polishing plate to a position above a second receiving station; and depositing the carrier plates on the second receiving station.

5. The method as claimed in claim 1, comprising polishing the workpieces on a first polishing plate;

simultaneously lifting the carrier plates off the first polishing plate;

displacing the polishing-plate superstructure, together with the carrier plates, along the linear guide from a position above the first polishing plate to a position above a second polishing plate;

polishing the workpieces on the second polishing plate;

simultaneously lifting the carrier plates off the second polishing plate;

displacing the polishing-plate superstructure, together with the carrier plates, along the linear guide from a position above the second polishing plate to a position above a receiving station; and depositing the carrier plates on the receiving station.

6. The method as claimed in claim 1, comprising simultaneously lifting the carrier plates off a first receiving station by means of a first polishing-plate superstructure;

displacing the first polishing-plate superstructure, together with the carrier plates, along the linear guide from a position above the first receiving station to a position above a first polishing plate;

polishing the workpieces on the first polishing plate;

simultaneously lifting the carrier plates off the first polishing plate by means of the first polishing-plate superstructure;

displacing the first polishing-plate superstructure, together with the carrier plates, along the linear guide from a position above the first polishing plate to a position above a second receiving station;

depositing the carrier plates on the second receiving station;

simultaneously lifting the carrier plates off the second receiving station by means of a second polishing-plate superstructure;

displacing the second polishing-plate superstructure, together with the carrier plates, along the linear guide from a position above the second receiving station to a position above a second polishing plate;

polishing the workpieces on the second polishing plate;

simultaneously lifting the carrier plates off the second polishing plate by means of the second polishing-plate superstructure;

displacing the second polishing-plate superstructure, together with the carrier plates, along the linear guide from a position above the second polishing plate to a position above a third polishing plate;

polishing the workpieces on the third polishing plate;

simultaneously lifting the carrier plates off the third polishing plate by means of the second polishing-plate superstructure;

displacing the second polishing-plate superstructure, together with the carrier plates, along the linear guide from a position above the third polishing plate to a position above a third receiving station; and depositing the carrier plates on the third receiving station.

7. A device for polishing disk shaped workpieces comprising a polishing line comprising at least three stations comprising at least a polishing plate and at least a receiving station for carrier plates;

at least two polishing-plate superstructures in which polishing heads are accommodated;

lifting means in the polishing heads for simultaneously lifting carrier plates off;

a linear guide situated above the polishing line and bearing the at least two polishing-plate superstructures; and means for displacing the polishing-plate superstructures along the linear guide, said means enabling the polishing plate superstructures to be displaceable independently along the linear guide either successively or simultaneously.

8. The device as claimed in claim 7, comprising means for decoupling the at least one polishing plate and the at least one polishing-plate superstructure one from the other both thermally and in terms of vibration mechanisms.

9. The device as claimed in claim 7, comprising three polishing-plates.

10. The device as claimed in claim 7, comprising three receiving stations.

11. The device as claimed in claim 7, wherein at least one receiving station is a tank filled with a liquid.

12. The device as claimed in claim 7, comprising means for extending modularly the linear guide and the polishing line.

* * * * *